United States Patent [19]

Brown et al.

[11] Patent Number: 4,872,400

[45] Date of Patent: Oct. 10, 1989

[54] LABORATORY WORK STATION WITH CONTROLLABLE ENVIRONMENT

[75] Inventors: Carlton E. Brown; Pierre C. de Pagter, both of Tucson, Ariz.

[73] Assignee: Air Concepts, Inc., Tucson, Ariz.

[21] Appl. No.: 282,620

[22] Filed: Dec. 12, 1988

[51] Int. Cl.[4] ..... B08B 15/02

[52] U.S. Cl. ..... 98/115.3; 98/115.1

[58] Field of Search ..... 98/36, 115.1, 115.3; 55/DIG. 18, DIG. 29

[56] References Cited

U.S. PATENT DOCUMENTS

| | | | |
|---|---|---|---|
| 3,356,006 | 12/1967 | Scott | 98/115.3 X |
| 3,363,539 | 1/1968 | Taylor et al. | 98/115.3 |
| 3,744,724 | 7/1973 | Caille | 98/36 X |
| 4,553,475 | 11/1985 | Saunders | 98/36 |
| 4,637,301 | 1/1987 | Shields | 98/115.3 |
| 4,666,478 | 5/1987 | Boissinut et al. | 98/115.3 |

*Primary Examiner*—Harold Joyce

*Attorney, Agent, or Firm*—Richard R. Mybeck

[57] ABSTRACT

Means and methods for maintaining laboratory work stations which have essentially open work areas, free of noxious and malodorous air contaminants by the use of tempered induction air combined with contaminant bearing exhaust air to limit the throughput of more expensive conditioned air. The means enables both the utilization of an integral lighting unit and the efficient collection of noxious air without creating unwanted drafts and currents.

6 Claims, 1 Drawing Sheet

LABORATORY WORK STATION WITH CONTROLLABLE ENVIRONMENT

INTRODUCTION

The present invention relates generally to a laboratory work station with a controlled environment and more particularly a unique work station providing for the treatment, management, containment, and disposition of contaminated air normally created in processing laboratories or teaching laboratories. Specifically, the assembly hereof provides means to control inhabitant exposure to fumes, gases, and particulates having potentially toxic or malodorous properties while reducing the use of temperature controlled air to a minimum.

BACKGROUND OF THE INVENTION

Energy conservation and protection from noxious air contaminants represents two divergent goals for a conditioned air environment, that is prewarmed air for cold climates and precooled for warm climates. The use of large amounts of make-up air through an exhaust system can effectively sweep the temperature controlled area free from air contaminants. However, the use of such energy conditioned air in large quantities inevitably results in untoward and expensive energy usage.

The use of totally enclosed hoods which limit the availability of accessible work area and the ability to observe what occurs therewithin, while effectively controlling the dispersion of noxious fumes, does not lend itself to adequate or desirable supervision when untrained students are conducting those chemical experiments which are so necessary to the learning process.

The present invention provides the educational laboratory with good visual observation, minimal energy requirements, plus effective air and fume control, all of which are essential to teaching the laboratory arts, especially chemistry. It accomplishes these goals by providing make-up air which is used primarily as the carrier fluid for said noxious fumes and particulates, thus avoiding the use of large volumes of expensive temperature controlled air. In moderate climates, outside air can be used directly. In severe climates, the outdoor air should be tempered before use.

The extraction of noxious gases and fumes takes place near the bench top, thus affording the most efficient use of the air induction/partial pressure air removal that is easily adjustable to prevent unwanted currents or drafts, even at low air induction volumes.

BRIEF SUMMARY OF THE INVENTION

The present invention provides means and methods for maintaining laboratory work stations which have essentially open work areas, free of noxious and malodorous air contaminants by the use of tempered induction air combined with contaminant bearing exhaust air to limit the throughput of the more expensive conditioned air. The equipment design and implementation allow the use of an integral lighting unit and the efficient collection of noxious air without incurring unwanted drafts or currents.

Accordingly, a prime object of the present invention is to provide a better and more efficient laboratory work station having a novel air distribution device to remove odors, fumes and irritants from chemistry laboratories.

Another object of the present invention is to provide a new and improved laboratory work station with a controllable environment having in combination a supply plenum, distribution means, a diffusion plate, an air canopy, an exhaust plenum and a perforated exhaust equalization plate.

A further object of the present invention is to provide new and improved means for removing obnoxious odors and fumes from a chemical laboratory work bench employing a low velocity diffusion plate.

Still another object of the present invention is to provide new and improved means for controlling the environment on a chemistry laboratory work bench which allows one or more appropriate light fixtures to be installed therein without interference with the air flow therethrough.

These and still further objects as shall hereinafter appear are readily fulfilled by the present invention in a remarkably unexpected manner as will be readily discerned from the following detailed description of an exemplary embodiment thereof, especially when read in conjunction with the accompanying drawing in which like parts bear like numerals through the several views.

DESCRIPTION OF THE PREFERRED EMBODIMENT

Figure 1:
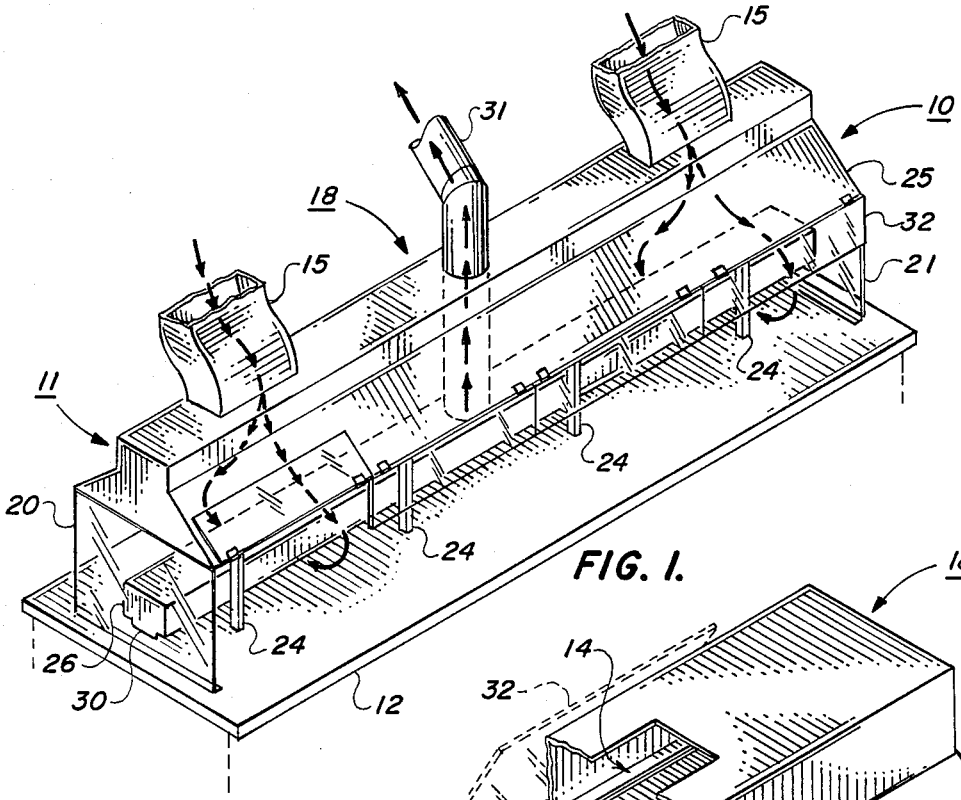
FIG. 1 is an isometric view of a complete laboratory work station embodying the present invention.
Figure 2:
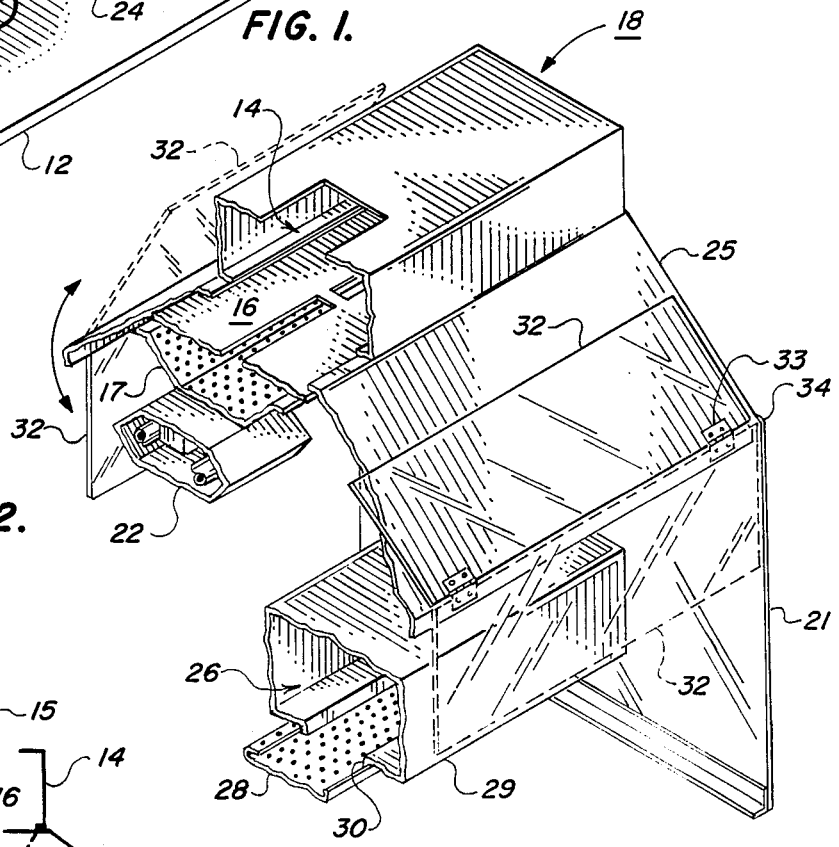
FIG. 2 is an enlarged fragmented isometric view of the exhaust structure of the work station of FIG. 1.

Referring to the drawing and particularly to FIG. 1, a laboratory work station embodying the present invention is identified by the general reference 10. Each work station 10 comprises a contaminant collection hood assembly 11 attached to a laboratory bench 12. Each hood assembly 11 has an ingress air diffusion channel 14 extending the entire length of the hood assembly 11 and supplied by one or more ingress air supply ducts 15 attached to and forming a part of ingress air diffusion channel 14.

Ingress air slotted baffle 16 is formed as the partitioning floor of ingress air diffusion channel 14 and coacts therewith to proportion the air flow along the length thereof. A perforated plate 17 is attached to the underside of slotted baffle 16 to complete the ingress air assembly 18 which extends between Plexiglass® end plates 20, 21, respectively. Appropriate interior illumination is provided for work station 10 by the internal light 22 which is mounted below perforated plate 17 and extends axially along hood assembly 11. Each light 22 is normally a fixture of about four feet in length. A plurality of such fixtures may be used on eight foot centers when longer hood assemblies 11 are employed to meet the exigencies of a given installation.

Figure 3:
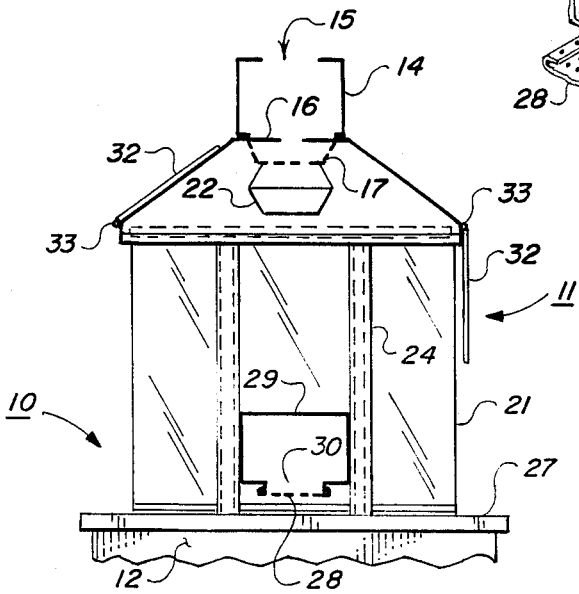
FIG. 3 is a cross-sectional view taken on line 3—3 of FIG. 2.

As shown in FIGS. 1 and 3, ingress air assembly 18 is supported upon a series of bipodal supports 24 which are disposed in spaced generally parallel relationship to each other along the axial length of work station 10.

Each member of each bipodal support 24 extends downwardly from the adjacent canopy side 25 past egress air channel 26 into seated engagement with bench top 27. Egress air channel 26 passes through air duct 29 and out exit air duct 31. Air duct 29 is supported in spaced relationship to bench top 27 by the bipodal supports 24 and has a perforated plate 28 disposed in the mouth 30 thereof in juxtaposition to receive the existing air therethrough. As shown in FIG. 1, the air flow pattern enters through ducts 15 and passes through baffle 16 and plate 17 around light fixture 22 to sweep along the inner surface of canopy sides 25 through the work area and into mouth 30 for exit via egress air duct 29 and exit air duct 31.

Plexiglass® shields 32 are mounted as with suitable hinges 33 at one or more locations along the outreaching edge 34, preferably both front and back, of sloped canopy members 25 of ingress air assembly 18. Shields 32 may be pivoted about hinges 33 from a nonfunctional position on top of canopy member 25 into a functional position depending vertically from edge 34 of canopy 25.

Ancillary fans are used to supply ingress air. This air may be tempered or partially treated to avoid (a) condensation problems if the ingress air is cold, or (b) excessive heating, if the ingress air supply is hot. Such treatment is minimal. Air supply may be sourced from the outside environment or it may originate from an auxiliary plenum area depending on the climate where the laboratory is located. Egress air is removed from the work bench surface through the use of the negative pressure created by an ancillary exhaust fan.

In operation, tempered ingress air is supplied through ingress air duct 15 and flows over and through slotted plate 16 which distributes and regulates the air flow that is passed to and through perforated plate 17 that further directs the air flow over and around the lighting fixtures 22. The air flow is further contained by sloped canopy sides 25 and plexiglass end plates 20, 21 and plexiglass shields 32 when they are deployed vertically about hinges 33.

The ingress air, provided as described above, is mixed with a small quantity of conditioned air and the noxious fumes generated at the work station 10 and the resulting mixture is drawn into and through perforated plate 28 which controls the air flow and prevents high velocity regions of extraction before passing through egress channel 26 and into egress air duct 29 to the ancillary exhaust fan and finally into the disposal, filtration or wash system, whichever is selected for the particular installation.

The ingress induction air supplies most of the make-up air that is required for the system thereby retaining within the system most of the expensive completely air conditioned room air and affording economical and complete fume or noxious air removal. Further fume protection is provided through the use of the plexiglass shields 32 that may be placed in a vertical depending position in the event of copious fume production, or to provide protection from violent reactions. The ingress induction air is controlled to prevent its intrusion into the conditioned room air. The system is designed to supply, for example, 60 CFM induction air per lineal foot of bench top, and to exhaust 80 CFM per lineal foot of work bench. Usage of fully conditioned room air is limited therefore to the differential of 20 CFM per lineal foot of work bench.

The open design afforded by the elevation of the hood structure by the bipodal support structures 24, and the see-through plexiglass end plates 20, 21 allow complete work visibility and also allows one supervisor or student instructor to monitor several work stations at the same time thereby assuring proper safety and economy of operation.

The system thus has the effect of diluting and extracting fumes caused by noxious and odorous reactions at a rate of 80 CFM per lineal foot at a cost of only 20 CFM per lineal foot of preconditioned room air.

Furthermore, since the majority of all particulate matter and reaction products are heavier than air, the extraction of such materials along the lower horizontal surface is a decided improvement over the equipment heretofore available.

From the foregoing, it is readily apparent that a laboratory work station has been herein described and illustrated which fulfills all of the aforestated objectives in a remarkably unexpected fashion. It is of course understood that such modifications, alterations and adaptations that may readily occur to the artisan confronted with this disclosure are intended within the spirit of the present invention which is limited only by the scope of the claims appended hereto.

Accordingly, what is claimed is

1. A laboratory work station having a controllable environment and adapted for installation in combination with a laboratory work bench, said work station comprising: a hood assembly having a housing; a plurality of air supply ducts, an ingress air channel for receiving air from said supply ducts and having a baffle plate in a lower portion and a perforated differential plate for directing air therefrom toward said work bench, said housing having a first and second sloped canopy depending from said air supply ducts in a diverging relationship to each other; lighting means secured to said hood assembly and depending therefrom in nonobstructive relationship to said air flow; support means operatively interposed between said work bench and said hood assembly to maintain said hood assembly in fixed spatial relationship to said work bench; an egress air channel disposed adjacent said work bench and adapted to receive and divert the air flow passing from said hood assembly through said work station into said egress air channel.

2. A laboratory work station according to claim 1 in which each of said canopy sides has a depending edge having a plurality of hinge members secured thereto in spaced relationship to each other and a plurality of discrete shield members are secured to each pair of said hinge members for pivotal action thereabout.

3. A laboratory work station according to claim 1 in which a work area is defined between said hood assembly and said work bench, said area being open on each side thereof and closed at each end thereof with a transparent panel.

4. A laboratory work station according to claim 2 in which a work area is defined between said hood assembly and said work bench, said area being open on each side thereof and closed at each end thereof with a transparent panel.

5. A laboratory work station according to claim 4 in which the area of each of said open sides thereof is selectively reducible by rotating one or more of said shield members about said hinge members until said shield member is disposed in a vertical plane.

6. A laboratory work station according to claim 2 in which said discrete shield members are transparent.

* * * * *